US011465017B2

(12) United States Patent
Lin

(10) Patent No.: US 11,465,017 B2
(45) Date of Patent: Oct. 11, 2022

(54) LUMINOUS SAFETY BALL

(71) Applicant: Blackstar Corp., New Taipei (TW)

(72) Inventor: Wei-Hung Lin, New Taipei (TW)

(73) Assignee: BLACKSTAR CORP., New Taipei (TW)

( * ) Notice: Subject to any disclaimer, the term of this patent is extended or adjusted under 35 U.S.C. 154(b) by 5 days.

(21) Appl. No.: 17/132,082

(22) Filed: Dec. 23, 2020

(65) Prior Publication Data

US 2021/0197032 A1 Jul. 1, 2021

(30) Foreign Application Priority Data

Dec. 25, 2019 (TW) ..... 108147509

(51) Int. Cl.

| | |
|---|---|
| ***A63B 43/06*** | (2006.01) |
| ***F21V 3/06*** | (2018.01) |
| ***F21V 31/00*** | (2006.01) |
| ***F21L 4/00*** | (2006.01) |
| ***F21V 3/02*** | (2006.01) |
| ***A63B 43/04*** | (2006.01) |
| ***A63B 37/12*** | (2006.01) |
| *F21Y 115/10* | (2016.01) |
| *A63B 102/18* | (2015.01) |
| *A63B 39/06* | (2006.01) |
| *A63B 39/00* | (2006.01) |

(52) U.S. Cl.

CPC ..... *A63B 43/06* (2013.01); *A63B 37/12* (2013.01); *F21L 4/00* (2013.01); *F21V 3/02* (2013.01); *F21V 3/063* (2018.02); *F21V 31/005* (2013.01); *A63B 39/06* (2013.01); *A63B 43/04* (2013.01); *A63B 2037/125* (2013.01); *A63B 2039/003* (2013.01); *A63B 2102/18* (2015.10); *A63B 2102/182* (2015.10); *A63B 2209/00* (2013.01); *A63B 2225/74* (2020.08); *F21Y 2115/10* (2016.08)

(58) Field of Classification Search

CPC ..... A63B 43/06; A63B 37/12; A63B 39/06; A63B 43/04; A63B 2037/125; A63B 2039/003; A63B 2102/18; A63B 2102/182; A63B 2209/00; A63B 2225/74; A63B 2071/009; A63B 2208/12; F21L 4/00; F21V 3/02; F21V 3/063; F21V 31/005; F21Y 2115/10

See application file for complete search history.

(56) References Cited

U.S. PATENT DOCUMENTS 3,011,048 A * 11/1961 O'Brien ..... A63B 43/06 362/208
3,580,575 A * 5/1971 Speeth ..... A63B 43/06 482/84

(Continued)

FOREIGN PATENT DOCUMENTS

FR 2487683 A1 * 2/1982

*Primary Examiner* — Steven B Wong
(74) *Attorney, Agent, or Firm* — Li & Cai Intellectual Property (USA) Office

(57) ABSTRACT

A luminous safety ball including an inner glowing body and a foam sphere covering the inner glowing body is provided. The inner glowing body is not a perfect sphere, the foam sphere has a non-uniform thickness, and light emitted by the inner glowing body passes through the foam sphere and permeates through a surface of the foam sphere to form light with different brightness thereon.

8 Claims, 13 Drawing Sheets

(56) References Cited

U.S. PATENT DOCUMENTS 3,804,411 A * 4/1974 Hendry ..... A63B 43/06 446/439
5,375,839 A * 12/1994 Pagani ..... A63B 43/00 473/570
5,388,825 A * 2/1995 Myers ..... A63B 43/06 473/570
5,490,047 A * 2/1996 O'Rourke ..... A63B 43/06 362/361
6,042,487 A * 3/2000 Schrimmer ..... A63B 43/06 473/370
6,142,894 A * 11/2000 Lee ..... A63B 43/06 473/570
6,575,855 B1 * 6/2003 Buzak ..... A63B 43/06 273/DIG. 8
6,666,782 B1 * 12/2003 Wu ..... A63H 33/22 446/485
6,733,149 B1 * 5/2004 Chuang ..... A63B 43/06 446/175
7,163,313 B2 * 1/2007 Rosenberg ..... F21V 15/01 362/186
8,727,918 B1 * 5/2014 Gentile ..... A63B 43/06 473/588
10,159,874 B1 * 12/2018 Lin ..... A63B 37/12
10,194,640 B2 * 2/2019 Lai ..... H01H 35/144
11,167,180 B2 * 11/2021 Tattersfield ..... G06F 1/163
2001/0049311 A1 * 12/2001 Lewis ..... A63B 43/06 473/570
2006/0146525 A1 * 7/2006 Chernick ..... F21V 33/008 362/196
2014/0127967 A1 * 5/2014 Liao ..... G02B 5/0236 252/582
2014/0308875 A1 * 10/2014 Renforth ..... A63H 33/22 446/485
2016/0354665 A1 * 12/2016 Greenwait ..... A63B 43/06
2016/0354666 A1 * 12/2016 Greenwait ..... G09B 19/0038
2017/0065856 A1 * 3/2017 Lin ..... A63B 69/0002
2018/0070560 A1 * 3/2018 Gelardi, II ..... A63B 43/06
2020/0139203 A1 * 5/2020 Lin ..... A63B 43/06
2020/0261773 A1 * 8/2020 Ganson ..... A63B 37/02

* cited by examiner

LUMINOUS SAFETY BALL

CROSS-REFERENCE TO RELATED PATENT APPLICATION

This application claims the benefit of priority to Taiwan Patent Application No. 108147509, filed on Dec. 25, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a ball, and more particularly to a luminous safety ball.

BACKGROUND OF THE DISCLOSURE

Currently, most baseballs and softballs are made of relatively hard materials. Since people (children) can be injured easily when being hit by the hard baseballs and softballs, such baseballs and softballs are not suitable for children to play with. Therefore, baseballs and softballs made of foam materials are now commercially available and safe to play with for both adults and children. However, the foam material has a low light transmittance and is not suitable for including a light emitting module, which greatly reduces the fun of playing with the baseballs and the softballs made of foam materials at night or in environments with insufficient lighting.

Therefore, it has become an important issue in the industry to overcome the afore-mentioned inadequacies.

SUMMARY OF THE DISCLOSURE

In response to the above-referenced technical inadequacies, the present disclosure provides a luminous safety ball.

In one aspect, the present disclosure provides a luminous safety ball including an inner glowing body and a foam sphere covering the inner glowing body. The inner glowing body is not a perfect sphere, the foam sphere has a non-uniform thickness, and light emitted by the inner glowing body passes through the foam sphere and permeates through a surface of the foam sphere to form lights with different brightness thereon.

In a preferable embodiment, the inner glowing body has a surrounding side wall, and a top wall and a bottom wall disposed opposite to each other in a vertical direction and connected to the surrounding side wall. The thickness of the foam sphere at a position corresponding to the surrounding wall of the inner glowing body is smaller than that at a position corresponding to the top wall of the inner glowing sphere, and the thickness of the foam sphere at the position corresponding to the surrounding wall is smaller than that at a position corresponding to the bottom wall of the inner glowing sphere.

In a preferable embodiment, the inner glowing body includes an LED light emitting module, such that the inner glowing body emits the light through the LED light emitting module.

In a preferable embodiment, the luminous safety ball further includes a cover layer. The cover layer covers the surface of the foam sphere, at least one seam gap and a plurality of stitch holes positioned on two sides of the at least one seam gap are formed on the cover layer, and the stitch holes are positioned corresponding to the surrounding side wall of the inner glowing body.

In a preferable embodiment, the surrounding side wall of the inner glowing body has a groove recessed inwardly, the groove surrounds the surrounding side wall, and the stitch holes are positioned on two sides of the groove.

In a preferable embodiment, a wall of the groove is configured to be an arc shape.

In a preferable embodiment, an airtight space is formed inside the inner glowing body.

In a preferable embodiment, the inner glowing body includes a support structure, and the support structure is in a shape of a honeycomb.

In a preferable embodiment, the foam sphere is made of a nano-foam material.

In a preferable embodiment, the luminous safety ball further includes a transparent waterproof protective layer, and the transparent waterproof protective layer covers the surface of the foam sphere.

In a preferable embodiment, the LED light emitting module includes a battery holding part and a counterweight member detachably disposed in the battery holding part.

In a preferable embodiment, a transparent coating layer is coated on an inner surface of the inner glowing body.

One of the beneficial effects of the luminous safety ball of the present disclosure is that the luminous safety ball includes an inner glowing body and a foam sphere covering the inner glowing body, the inner glowing body is not a perfect sphere, the foam sphere has a non-uniform thickness, and light emitted by the inner glowing body passes through the foam sphere and permeates through a surface of the foam sphere to form lights with different brightness thereon. Therefore, in the present disclosure, a thickness distribution of the foam sphere can be adjusted to adjust a light transmittance of the luminous safety ball, thereby enhancing the fun of playing with the luminous safety ball at night or in environments with insufficient lighting.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
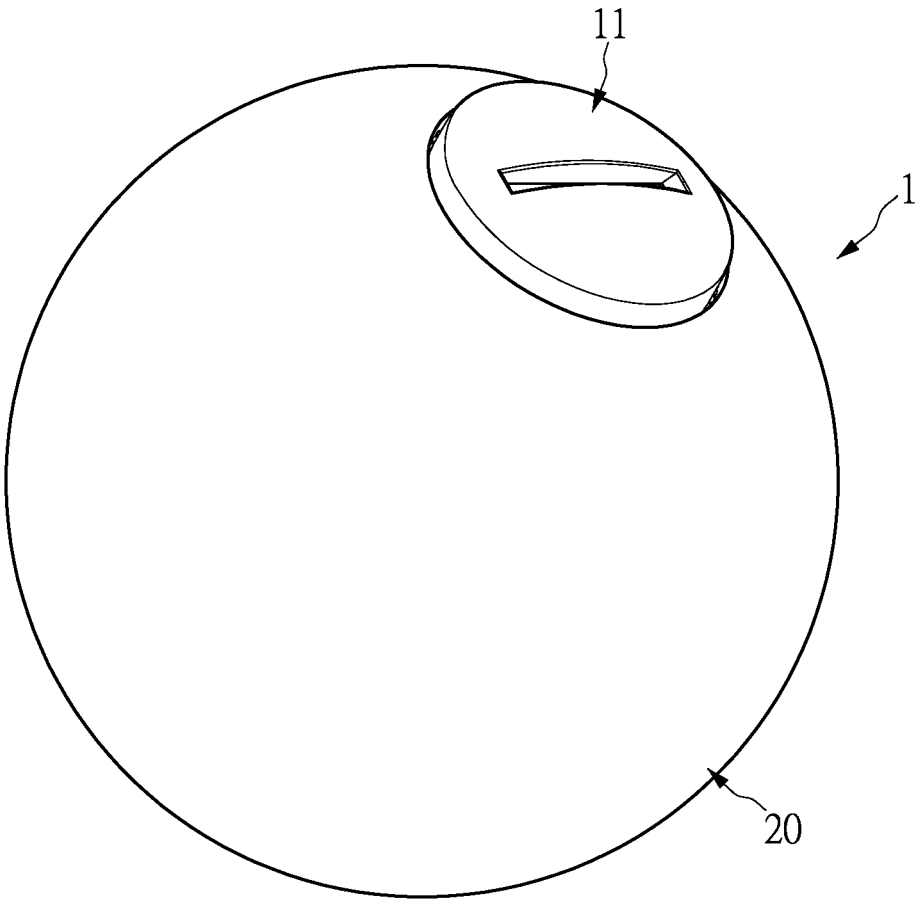
FIG. 1 is a perspective schematic view of a luminous safety ball in a first embodiment of the present disclosure.
Figure 2:
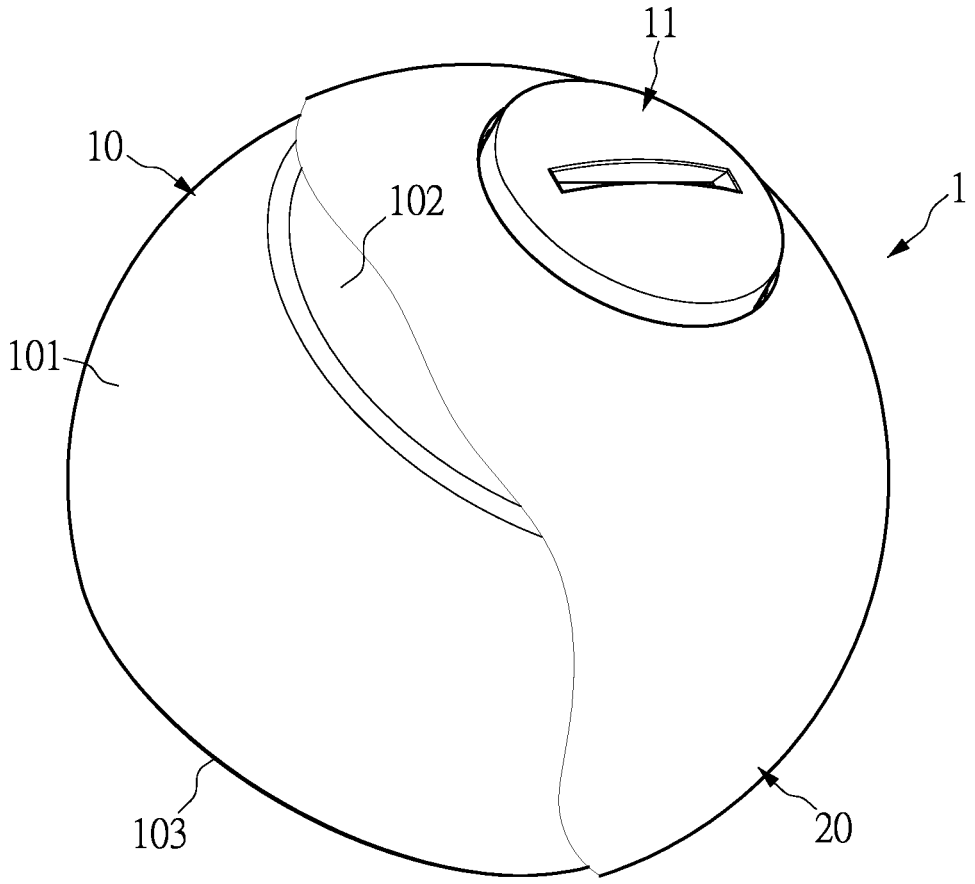
FIG. 2 is a schematic view showing a foam sphere of the luminous safety ball being partially removed in the first embodiment of the present disclosure.
Figure 3:
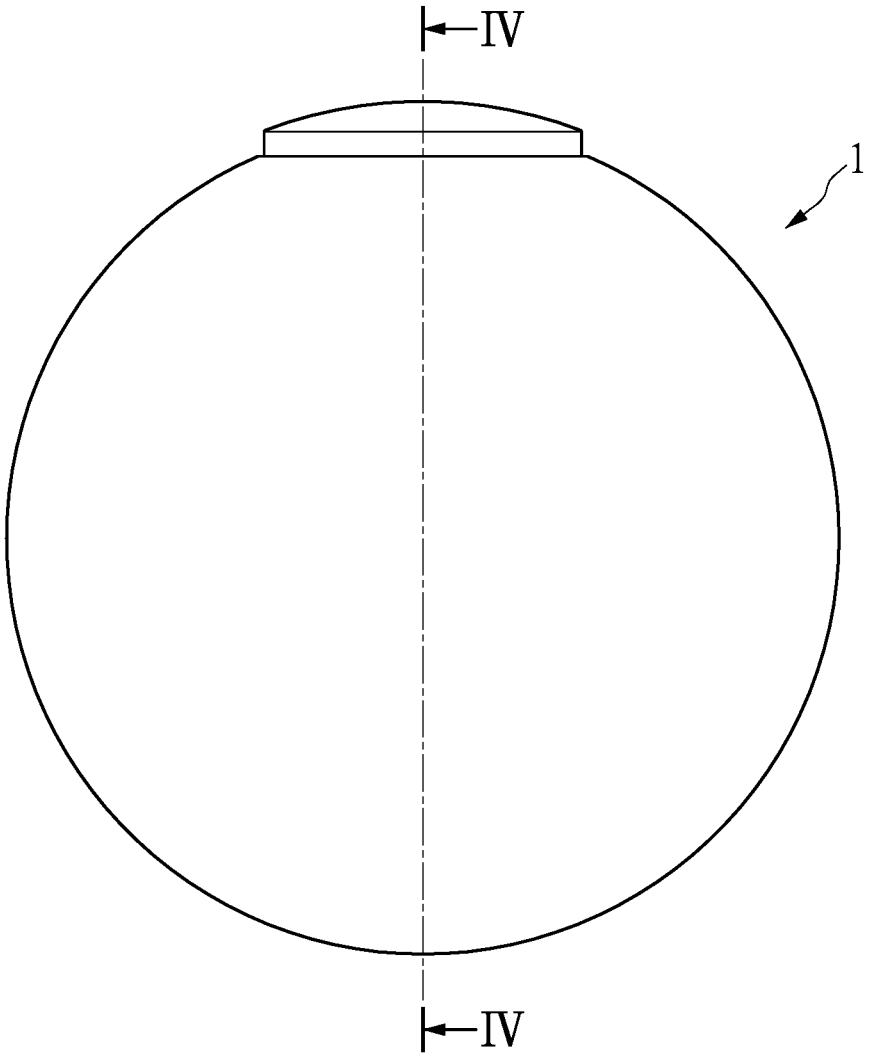
FIG. 3 is a side schematic view of the luminous safety ball in the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 4, an embodiment of the present disclosure provides a luminous safety ball 1, which basically includes an inner glowing body 10 and a foam sphere 20 covering the inner glowing body 10. That is to say, the luminous safety ball 1 in this embodiment of the present disclosure is a safety ball suitable for adults and children to play with since a foam material is provided to cover the inner glowing body 10.

Specifically, the inner glowing body 10 is not a perfect sphere, which can be made of a transparent or translucent elastic material. The inner glowing body 10 includes an LED light emitting module 11, such that the inner glowing body 10 can emit light through the LED light emitting module 11.

Furthermore, since the inner glowing body 10 is not a perfect sphere, and the foam sphere 20 covering the inner glowing body 10 has an ununiformed thickness, the light emitted from inside the inner glowing body 10 passes through the foam sphere 20 and permeates through a surface of the foam sphere 20 to form lights with different brightness thereon. Therefore, a light transmittance of the luminous safety ball 1 can be adjusted through appropriately adjusting a thickness distribution of the foam sphere 20.

Figure 4:
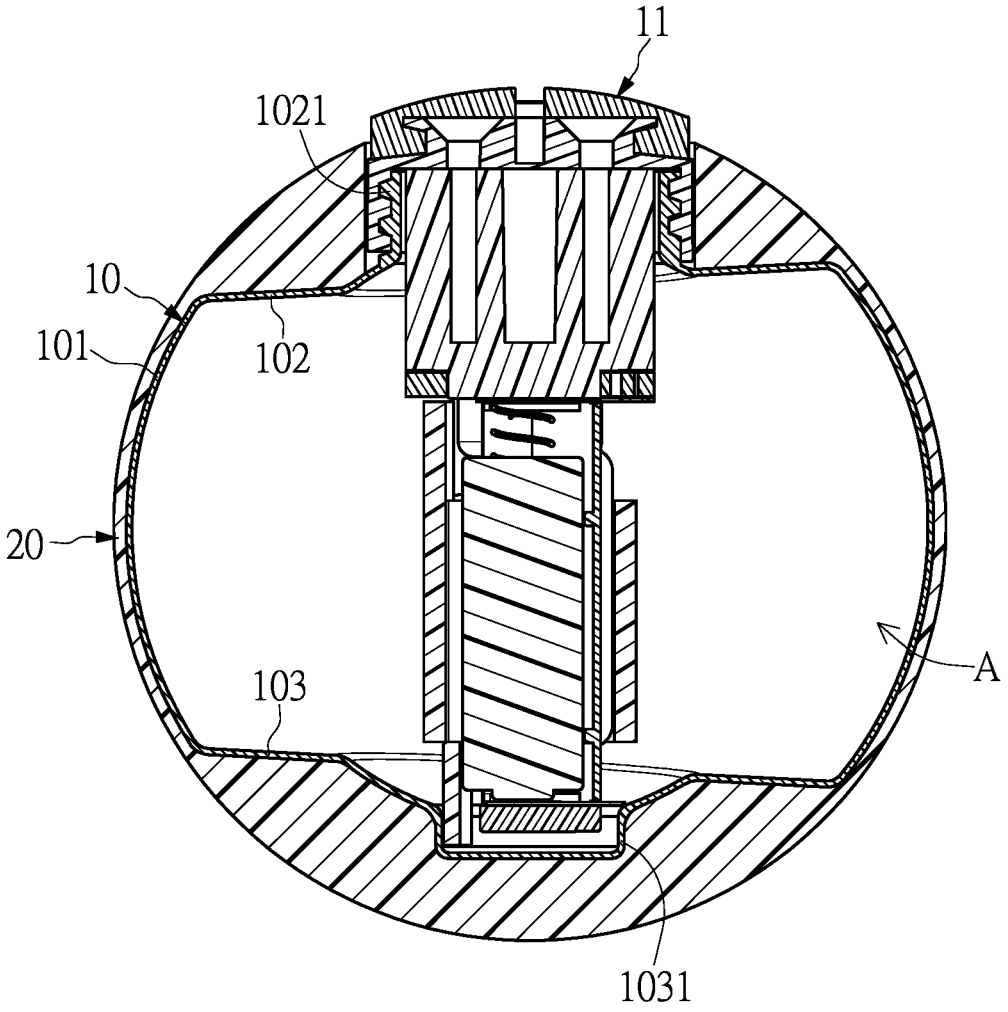
FIG. 4 is a cross-sectional schematic view taken along line IV-IV of FIG. 3.

Further, as shown in FIG. 4, the inner glowing body 10 has a surrounding side wall 101, and a top wall 102 and a bottom wall 103 that are disposed opposite to each other in a vertical direction and connected to the surrounding side wall 101. The thickness of the foam sphere 20 at a position corresponding to the surrounding side wall 101 of the inner glowing body 10 is relatively thinner, and the thickness of the foam sphere 20 at a position corresponding to the top wall 102 (or the bottom wall 103) of the inner glowing body 10 is relatively thicker. In other words, the thickness of the foam sphere 20 corresponding to the surrounding side wall 101 of the inner glowing body 10 is smaller than that at a position corresponding to the top wall 102 of the inner glowing body 10. In addition, the thickness of the foam sphere 20 corresponding to the surrounding side wall 101 of the inner glowing body 10 is smaller than that at a position corresponding to the bottom wall 103 of the inner glowing body 10. Therefore, the light permeating through the surface of the foam sphere 20 corresponding to the surrounding side wall 101 of the inner glowing body 10 is greater than the light permeating through the rest of the surface of the foam sphere 20.

In this embodiment, a mounting portion 1021 is protrudingly formed on the top wall 102, and the mounting portion 1021 can have a threaded pattern, such that a head portion of the LED light emitting module 11 is threadedly engaged to the top wall 102 of the inner glowing body 10. An accommodating portion 1031 is protrudingly formed on the bottom wall 103, such that a tail portion of the LED light emitting module 11 is accommodated in the accommodating portion 1031 and fixed on the bottom wall 103 of the inner glowing body 10. In another embodiment, the LED light emitting module 11 can be completely hidden (i.e., encapsulated) inside the inner glowing body 10, so that it is not required to form the mounting portion 1021 and the accommodating portion 1031 on the top wall 102 and the bottom wall 103, respectively.

In addition, the foam sphere 20 of this embodiment can be made of a nano-foam material. Since a diameter of pores of the nano-foam material is less than 50 nm, the light transmittance of the foam sphere 20 can be enhanced.

Second Embodiment

Figure 5:
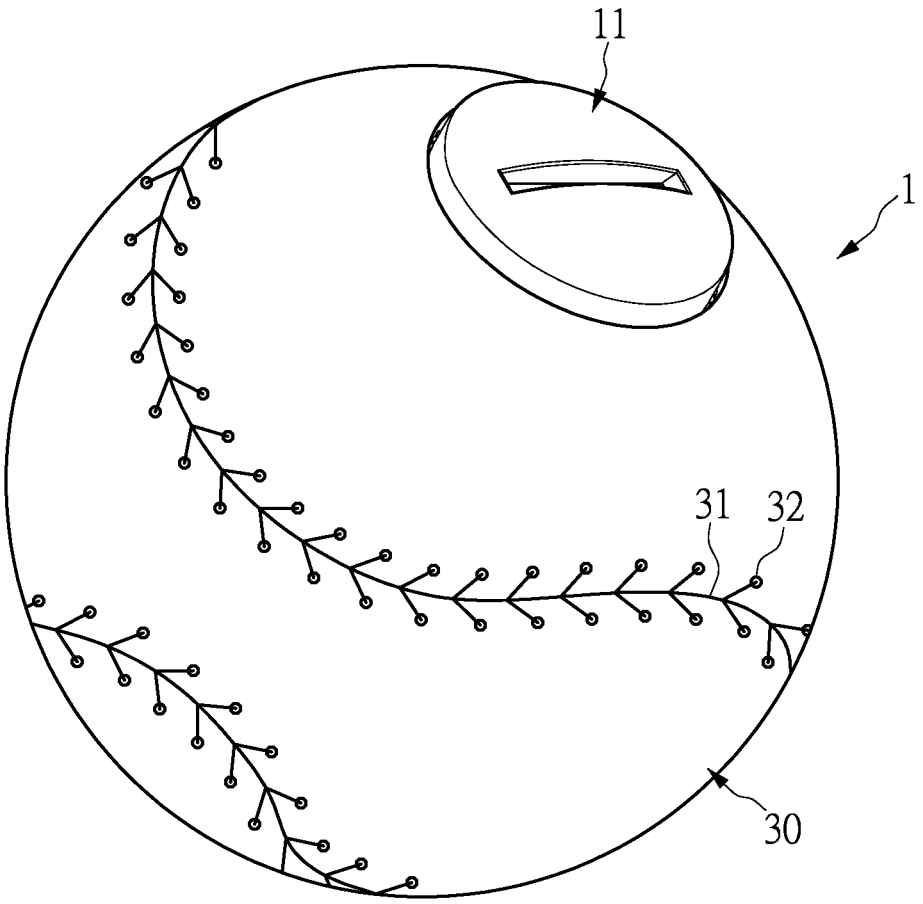
FIG. 5 is a perspective schematic view of the luminous safety ball in a second embodiment of the present disclosure.
Figure 6:
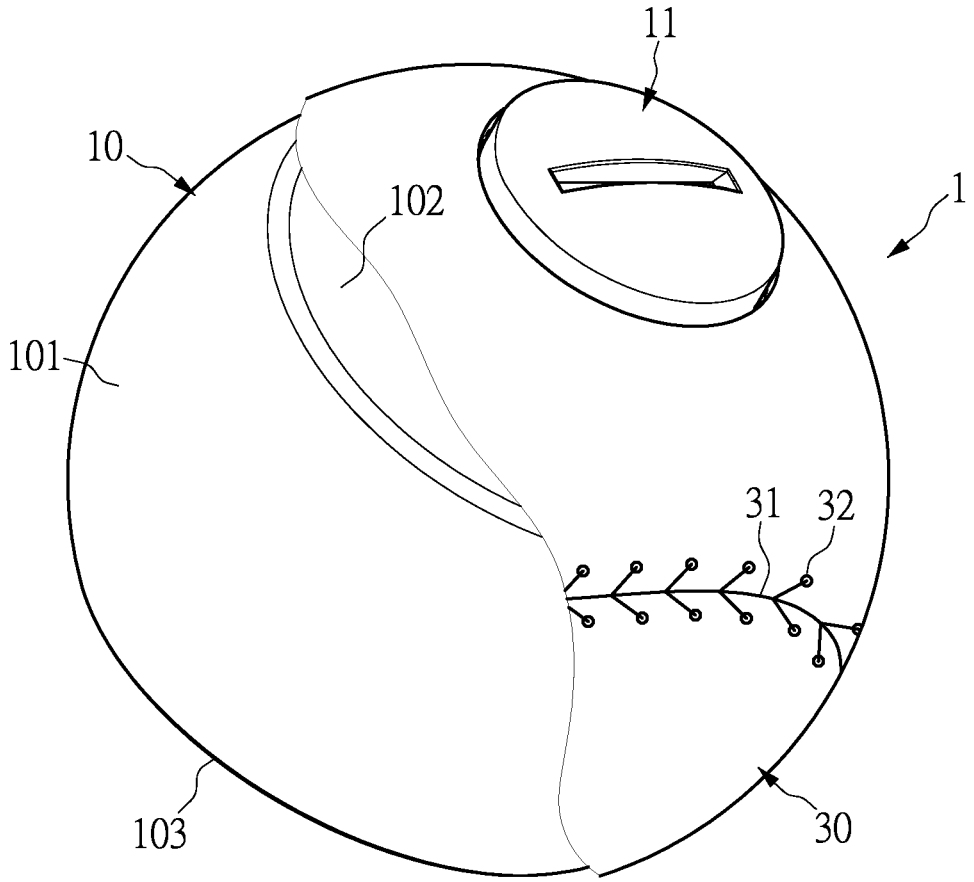
FIG. 6 is a schematic view showing the foam sphere of the luminous safety ball being partially removed in the second embodiment of the present disclosure.
Figure 7:
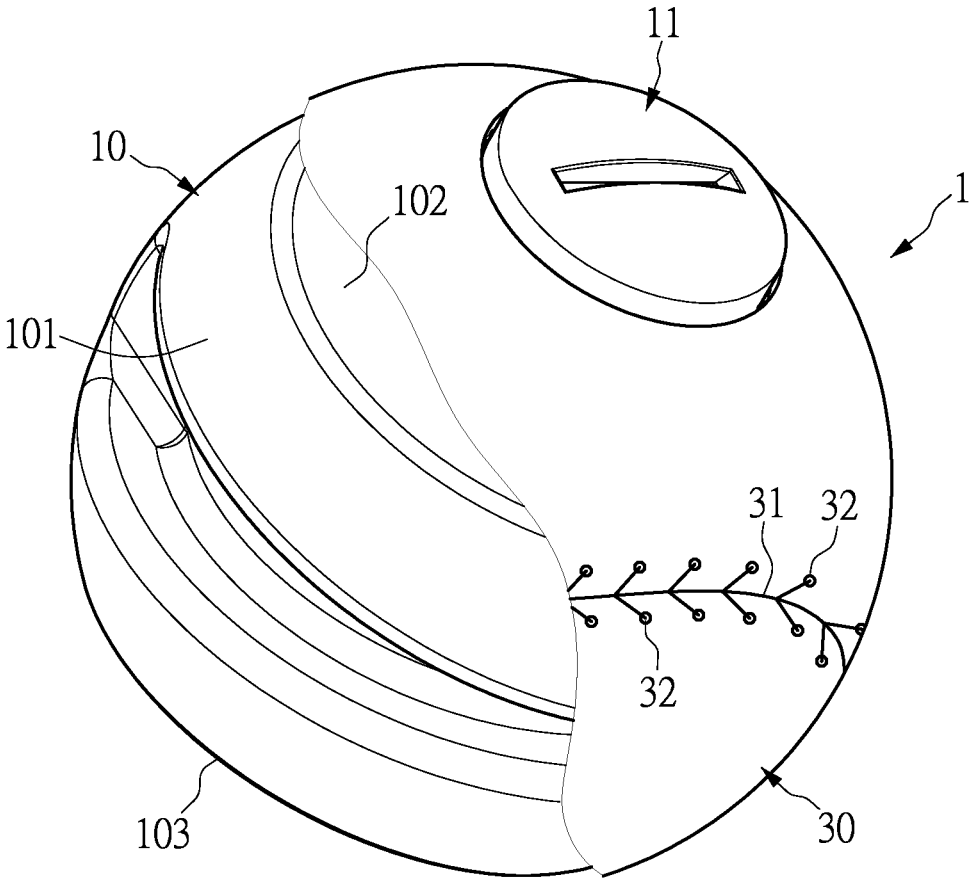
FIG. 7 is a schematic view showing the foam sphere of the luminous safety ball being partially removed in a third embodiment of the present disclosure.

Referring to FIG. 5 and FIG. 6, the luminous safety ball 1 further includes a cover layer 30, e.g., the skin of a baseball or a softball. In addition, the cover layer 30 can also be a light permeable layer that can partially or completely transmit light. The cover layer 30 can be covered on the surface of the foam sphere 20 as shown in FIG. 1, so as to form the luminous safety ball 1 as shown in FIG. 5.

Furthermore, the cover layer 30 is formed to have at least one seam gap 31 and a plurality of stitch holes 32 positioned on both sides of the at least one seam gap 31. The stitch holes 32 are positioned corresponding to the surrounding side wall 101 of the inner glowing body 10. Since the thickness of the foam sphere 20 at the position corresponding to the surrounding side wall 101 of the inner glowing body 10 is relatively thinner, a brightness of the light that is emitted by the inner glowing body 10 and that passes through the foam sphere 20 to shine from the stitch holes 32 is at its greatest. Therefore, in this embodiment, the light having the greatest brightness can be shone from the stitch holes 32 formed on the surface of the luminous safety ball 1, such that a user can clearly recognize a movement path of the luminous safety ball 1 through the light shone from the stitch holes 32 on the surface of the luminous safety ball 1 at night or in environments with insufficient lighting.

Third Embodiment

Figure 8:
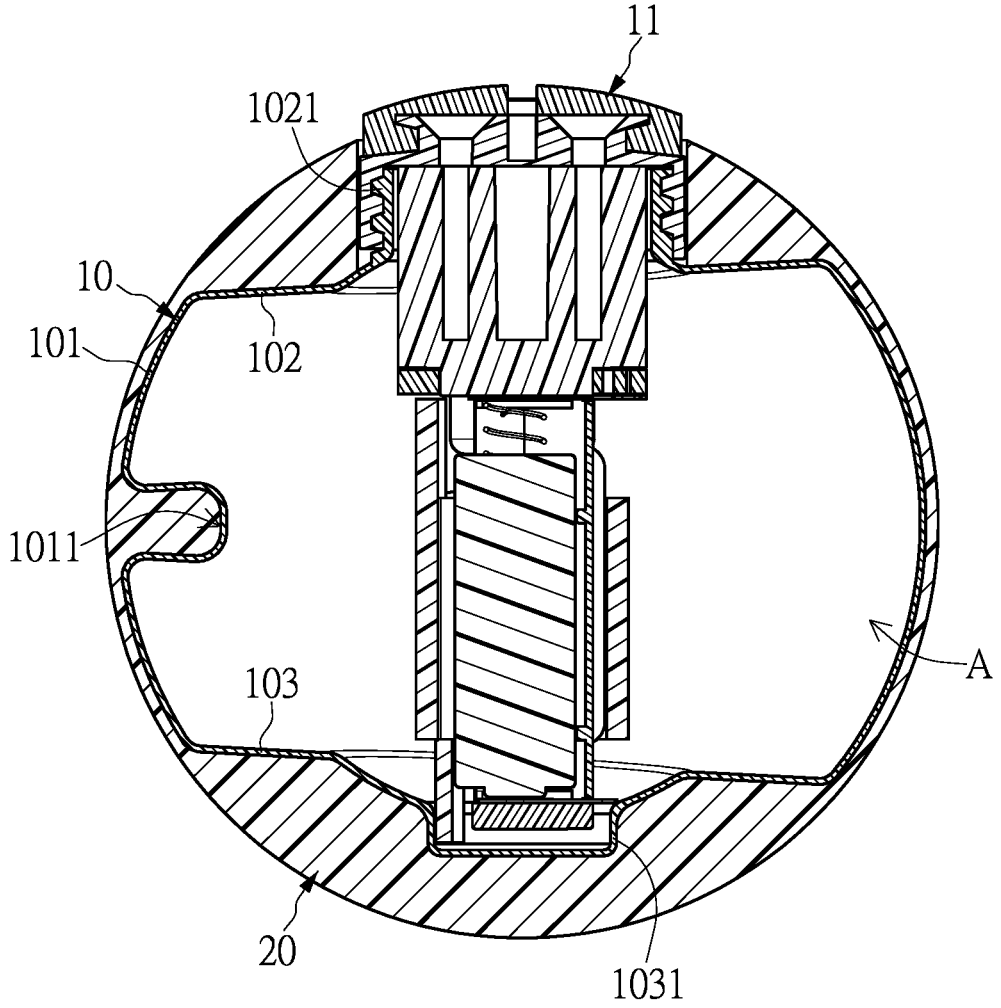
FIG. 8 is a cross-sectional schematic view of the luminous safety ball in the third embodiment of the present disclosure.
Figure 9:
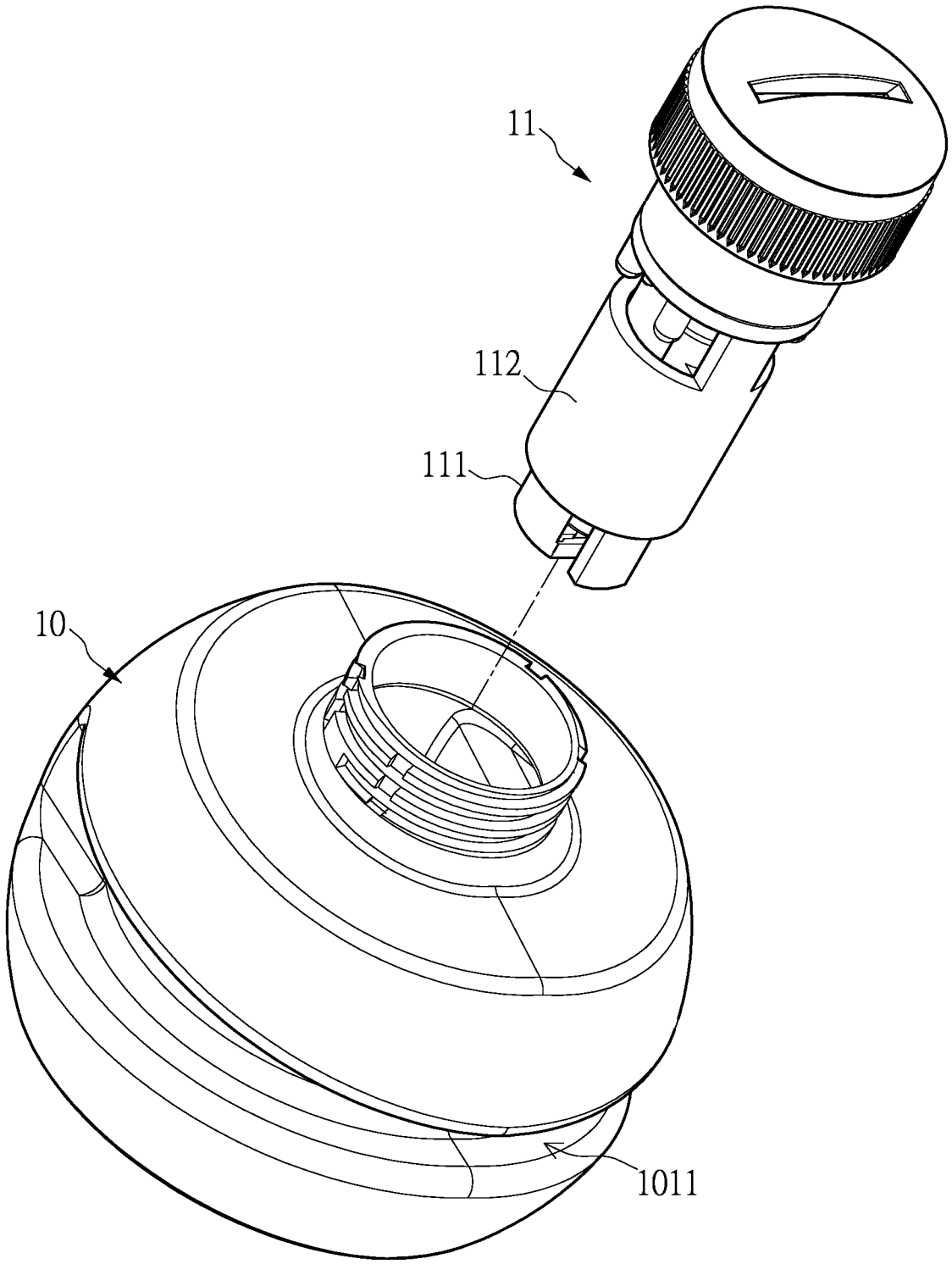
FIG. 9 is a partial schematic view of the luminous safety ball in the third embodiment of the present disclosure.
Figure 10:
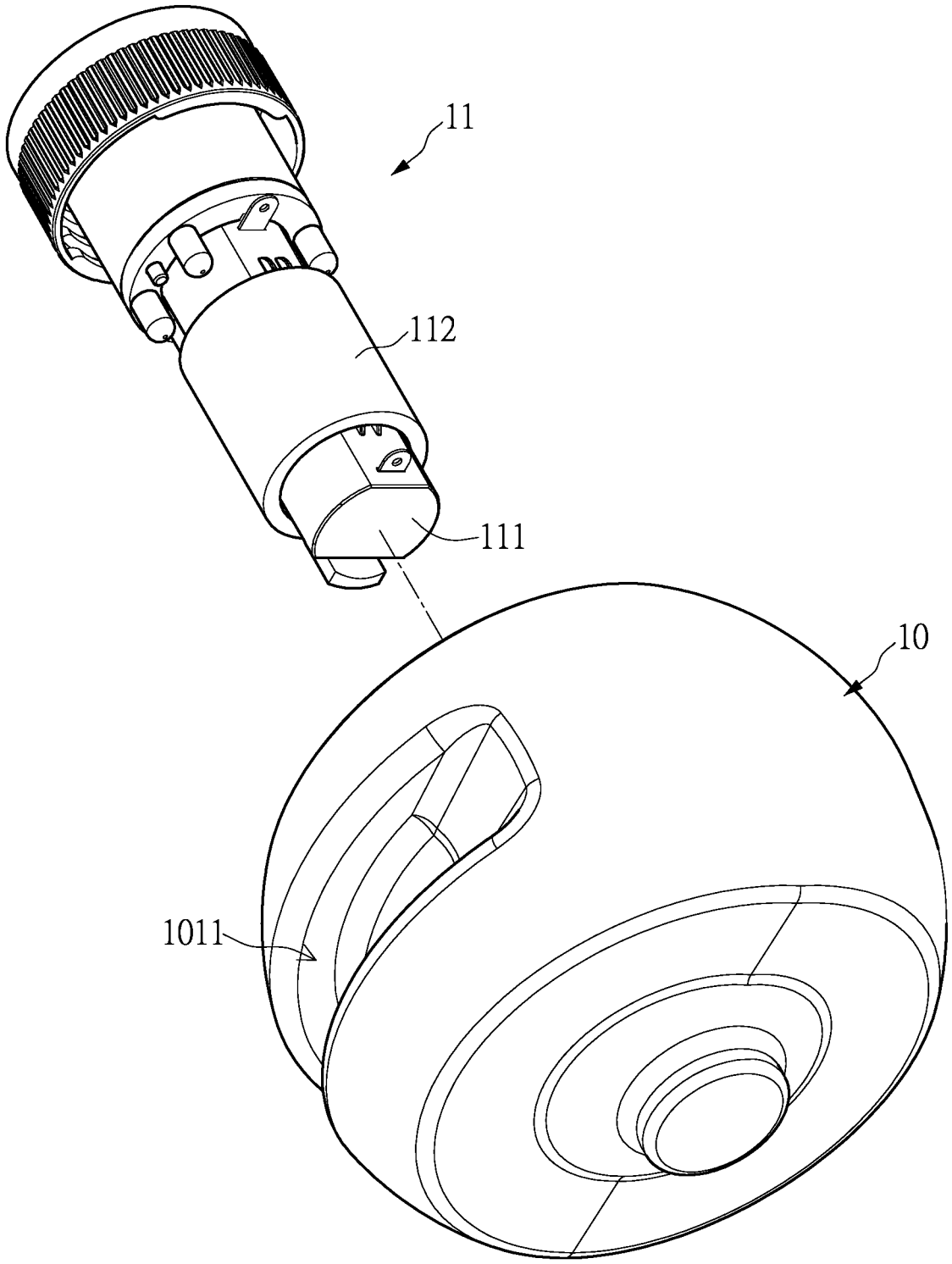
FIG. 10 is a partial schematic view of the luminous safety ball from another perspective in the third embodiment of the present disclosure.

Furthermore, referring to FIG. 7, FIG. 8, FIG. 9, and FIG. 10, in order to further increase the brightness of the light emitted from the stitch holes 32, in this embodiment, the surrounding side wall 101 of the inner glowing body 10 has a groove 1011 recessed inwardly (as shown in FIG. 8). The groove 1011 can surround the surrounding side wall 101. That is to say, the groove 1011 can completely surround the surrounding side wall 101, or partially surround the surrounding side wall 101. In this embodiment, the groove 1011 partially surrounds the surrounding side wall 101. Therefore, since the groove 1011 of the surrounding side wall 101 of the inner glowing body 10 is recessed inwardly, the thickness of the foam sphere 20 corresponding to the groove 1011 of the inner glowing body 10 is slightly thicker, such that the brightness of the light exposed from the stitch holes 32 at the two sides of the groove 1011 can be further increased.

In addition, an airtight state is formed inside the inner glowing body 10, so as to enhance a structural strength of the luminous safety ball 1. In other words, an airtight space A is formed inside the inner glowing body 10, such that the inner glowing body 10 can be supported and is not easily deformed. Furthermore, a wall of the groove 1011 is designed in an arc shape, which can also increase the structural strength of the luminous safety ball 1.

Fourth Embodiment

Figure 11:
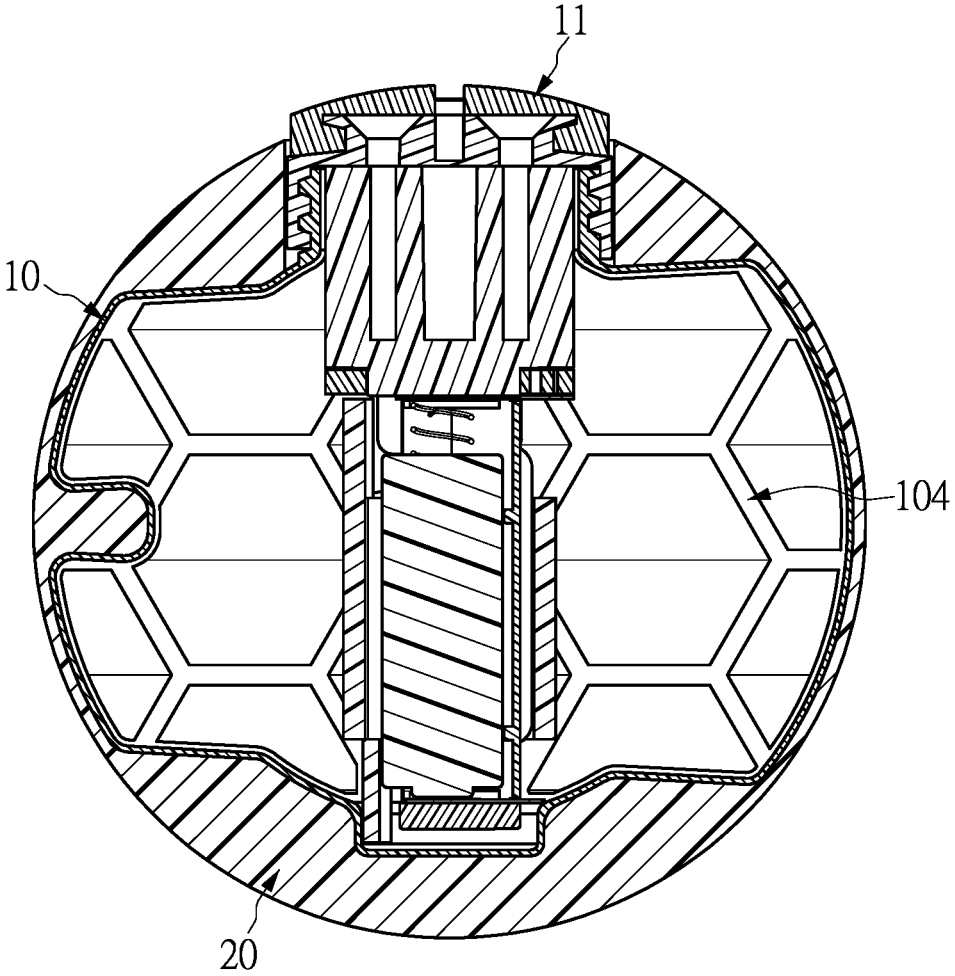
FIG. 11 is a cross-sectional schematic view of the luminous safety ball in a fourth embodiment of the present disclosure.

As shown in FIG. 11, in order to further enhance the structural strength of the luminous safety ball 1, a support structure 104 is provided inside the inner glowing body 10, and the support structure 104 is in a shape of a honeycomb. That is to say, the support structure 104 includes a plurality of plates arranged in a honeycomb structure, so as to further enhance the inner glowing body 10 in its ability to withstand impact.

Fifth Embodiment

Figure 12:
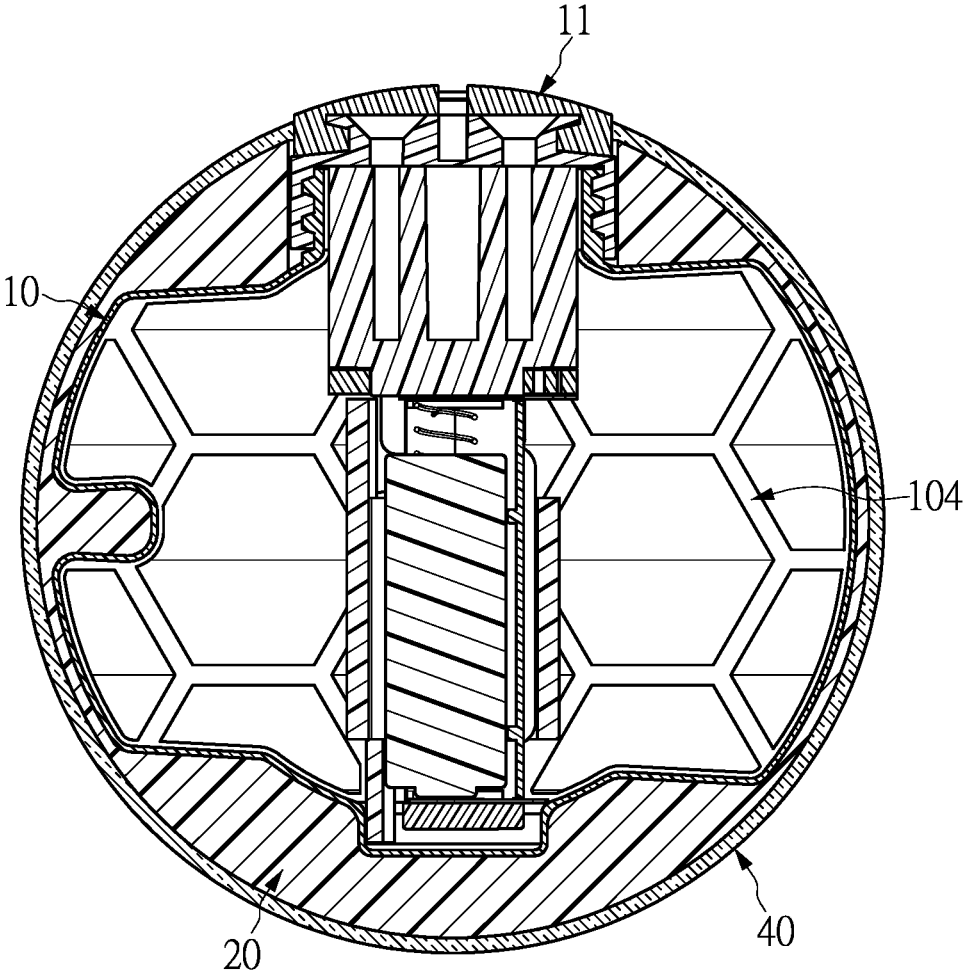
FIG. 12 is a cross-sectional schematic view of the luminous safety ball in a fifth embodiment of the present disclosure.

As shown in FIG. 12, in this embodiment, a transparent waterproof protective layer 40, e.g., a waterproof adhesive film, is formed on the surface of the foam sphere 20. In this way, a strength and waterproofness of the foam sphere 20 is enhanced.

Sixth Embodiment

Figure 13:
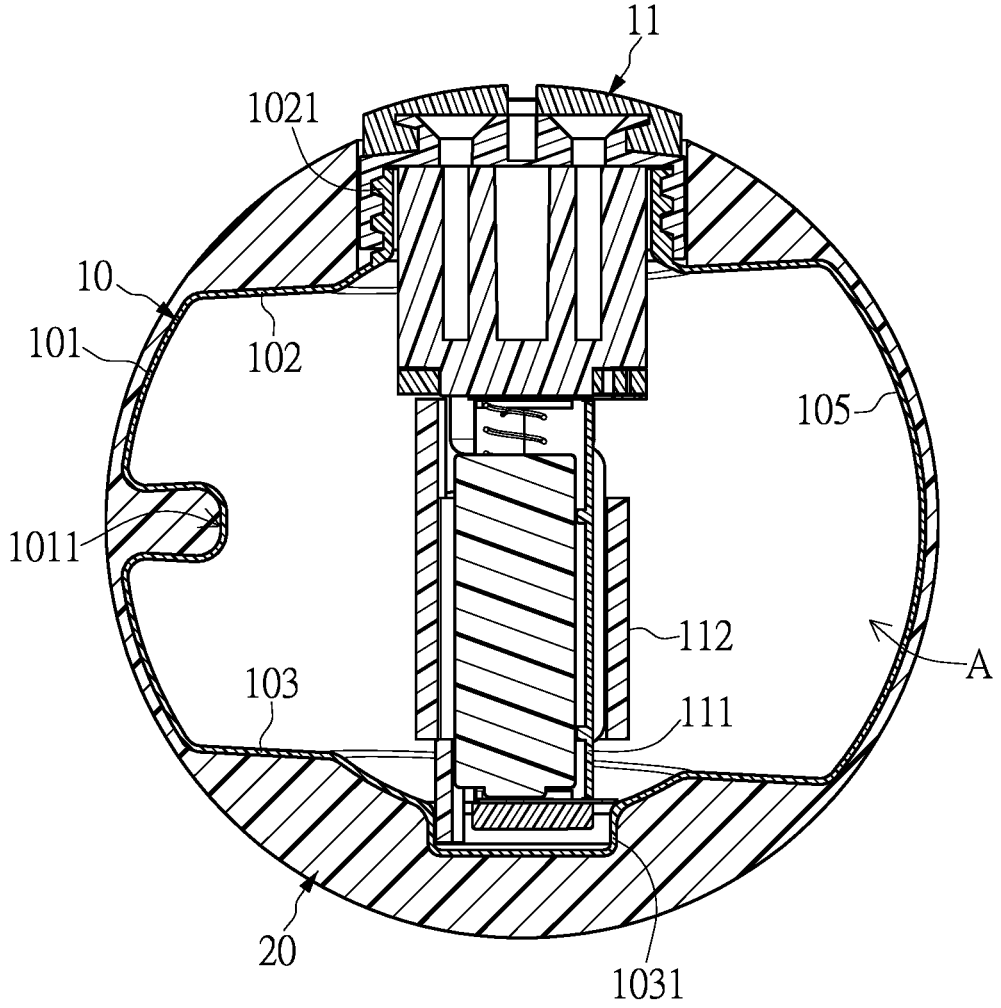
FIG. 13 is a cross-sectional schematic view of the luminous safety ball in a sixth embodiment of the present disclosure.

As shown in FIG. 13, in this embodiment, a transparent coating layer 105 is coated on an inner surface of the inner glowing body 10, and a thickness of the transparent coating layer 105 can be 1 mm to 10 mm, so as to enhance the strength of the inner glowing body 10 and adjust a weight of the luminous safety ball 1.

In addition, the LED light emitting module 11 disposed on the inner glowing body 10 has a battery holding part 111 and a counterweight member 112 detachably disposed in the battery holding part 111, such that the counterweight member 112 with different weights can be replaced to increase or adjust the overall weight of the luminous safety ball 1.

In conclusion, in the luminous safety ball of the present disclosure includes an inner glowing body and a foam sphere covering the inner glowing body, the inner glowing body is not a perfect sphere, the foam sphere has a non-uniform thickness, and light emitted by the inner glowing body passes through the foam sphere and permeates through a surface of the foam sphere to form lights with different brightness thereon. Therefore, in the present disclosure, the thickness distribution of the foam sphere can be adjusted to adjust the light transmittance of the luminous safety ball, thereby enhancing the fun of playing with the luminous safety ball at night or in environments with insufficient lighting.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A luminous safety ball, comprising:

an inner glowing body;

a foam sphere covering the inner glowing body; and a cover layer covering the foam sphere;

wherein the inner glowing body is not a perfect sphere, the foam sphere has a non-uniform thickness, and light emitted by the inner glowing body passes through the foam sphere and permeates through a surface of the foam sphere to form lights with different brightness thereon;

wherein the inner glowing body has a surrounding side wall, and a top wall and a bottom wall disposed opposite to each other in a vertical direction and connected to the surrounding side wall; wherein the thickness of the foam sphere at a position corresponding to the surrounding side wall of the inner glowing body is smaller than that at a position corresponding to the top wall of the inner glowing sphere; wherein the thickness of the foam sphere at the position corresponding to the surrounding side wall is smaller than that at a position corresponding to the bottom wall of the inner glowing sphere;

wherein at least one seam gap and a plurality of stitch holes positioned on two sides of the at least one seam gap are formed on the cover layer, and the stitch holes are positioned corresponding to the surrounding side wall of the inner glowing body;

wherein the surrounding side wall of the inner glowing body has a groove recessed inwardly, the groove surrounds the surrounding side wall, and the stitch holes are positioned on two sides of the groove.

2. The luminous safety ball according to claim 1, wherein a wall of the groove is configured to be in an arc shape.

3. The luminous safety ball according to claim 1, wherein an airtight space is formed inside the inner glowing body.

4. The luminous safety ball according to claim 1, wherein the inner glowing body includes a support structure, and the support structure is in a shape of a honeycomb.

5. The luminous safety ball according to claim 1, further comprising a transparent waterproof protective layer, wherein the transparent waterproof protective layer covers the surface of the foam sphere.

6. The luminous safety ball according to claim 1, wherein the inner glowing body includes an LED light emitting module, such that the inner glowing body emits the light through the LED light emitting module.

7. The luminous safety ball according to claim 6, wherein the LED light emitting module includes a battery holding part and a counterweight member detachably disposed in the battery holding part.

8. The luminous safety ball according to claim 1, wherein a transparent coating layer is coated on an inner surface of the inner glowing body.

* * * * *